US005358762A

United States Patent [19]

McGrath

[11] Patent Number: 5,358,762

[45] Date of Patent: Oct. 25, 1994

[54] RIGID POLYETHYLENE SANDWICH BOARD

[76] Inventor: Stephen E. McGrath, 64 Carl Crescent, Scarborough, Ontario, Canada

[21] Appl. No.: 107,574

[22] Filed: Aug. 18, 1993

[51] Int. Cl.[5] ..... G09F 15/00

[52] U.S. Cl. ..... 428/12; 428/119; 428/121; 40/610

[58] Field of Search ..... 428/119, 121, 12; 40/606, 610

[56] References Cited

U.S. PATENT DOCUMENTS 1,115,021 10/1914 Pummill ..... 40/610

*Primary Examiner*—Alexander S. Thomas

*Attorney, Agent, or Firm*—Jane Parsons

[57] ABSTRACT

A sandwich board is made of sheet plastics material such as polyethylene. The panels are inhibited from warping by inturned flanges along the edges. Along the rising edges the flanges may be permanently inturned by means of a reverse bend. Along the upper edge the flange may be hinged through double coined lines. A lower flange may also be hinged inwardly through double coined lines for rigidity. Braces may be provided on back panel surfaces for rigidity especially on large sandwich boards. The panels may be slightly offset from one another so that the inturned flanges internest. The outer surfaces of the panels are coated over the whole surface with an adherent ink which allows for later printing of information using cheaper conventional inks or paints.

10 Claims, 7 Drawing Sheets

RIGID POLYETHYLENE SANDWICH BOARD

BACKGROUND OF THE INVENTION

1. Field of the Invention

The invention relates to sandwich boards. Sandwich boards are panels which are hinged together at a top generally horizontal surface so that they may be folded flat or opened into a roof shape. Usually they are used for advertising purposes. The invention especially relates to free standing sandwich boards.

2. Description of the Prior Art

Sandwich boards have traditionally been made from any rigid flat material such as fibre board, chip board, wood, etc. Such sandwich boards utilize metal hinges and, where the board is attached to a frame, metal nails or staples or screws. The combination of materials used generally makes the sandwich boards unsuitable for recycling. Moreover, they tend to be heavy and also tend to deteriorate in bad weather conditions especially in rain.

The use of plastic materials for sandwich boards has been considered but plastic materials such as polyethylene have been considered to have had sufficient obvious disadvantages to cause their potential use to be viewed with disfavour.

Disadvantages of polyethylene which, when taken together, cause polyethylene to be viewed as an unsuitable material for forming sandwich boards are, for example, difficulty in printing on polyethylene, warping of polyethylene in varying temperature conditions, or the lightness of polyethylene.

Although the difficulty in printing on plastic materials has been largely overcome in many fields, the production of sandwich boards often require use of very easily available printing inks or paint. Economically, it has not been considered viable to utilize the specialized printing inks which are necessary for printing on plastics.

Warping of sheet plastic materials under varying temperature conditions causes bowing or dishing of the surface with consequent distortion of the subject matter printed on it. If the surface warps before the printing is to take place then the advertising material is permanently distorted and unacceptable.

Although the heaviness of the traditional sandwich boards is held against them, the extreme lightness of plastics material sandwich boards makes them liable to be blown away in windy conditions or blown over.

SUMMARY OF THE INVENTION

The present inventor has addressed the problems associated with the use of plastics material for forming sandwich boards and has devised a sandwich board of particular construction which takes advantage of the qualities of plastic materials, such as its recyclability, while overcoming the disadvantages due to other characteristics of the material.

Thus, according to the invention there is provided a sandwich board formed from rigid recyclable plastics material sheet, comprising a pair of overlying panels, each panel having an outer surface for the presentation of information, the outer surface being coated with an ink adherent to the plastics material; each panel having opposed elongate side flanges extending along opposed sides of the panel and bent inwardly at substantially 90 degrees from the outer surface thereof; each panel having a lower flange hingable inwardly from a horizontal hinge line in a lower part of the panel; the panels being hingably connected at respective top edges of the panel through at least one top member coextensive with the top edges of both panels; and limiting means extending between lower parts of the panel to limit the angle to which the panels hingable with respect to the top member.

Suitably the ink may be based on an air curing epoxy compound which adheres to polyethylene. Such an ink may be that sold under the trade mark Colonial 91.

The top member may be a flange common to both panels or each panel may have a top flange hingably connected thereto and these top flanges overlie one another in flush relationship and are attached together. This second alternative where two top flanges are connected together may add strength to the resulting sandwich board.

Suitably a lower flange is horizontally connected to a bottom edge or to a horizontal edge in a lower part of the panel. This lower flange may extend over the whole bottom edge or over part of said horizontal edge. It may provide strength in a lower portion of the panel when at an angle thereto. The limiting means may be a strap connecting lower parts of the panels. For example the strap may extend between the lower flanges acting to hold the lower flanges at an inward angle to the respective panels into a strengthening position. Alternatively lower flanges of the panels may be connected together to form the limiting means. In this latter case, the width of the lower flanges is chosen to define a suitable angle of opening. The lower flanges may be hinged to lower edges of the panels and to each other so that they fold up and lie flat within the sandwich board, when folded.

If large sandwich boards are contemplated it may be convenient to provide supplementary braces on back surfaces of the panels to act as a deterrent to dishing or bowing of the panels. Each brace may be a V-section elongate member tack welded to the panel in any configuration, for example, vertically and/or horizontally. For example, narrow tall sandwich boards may have two or more cross braces and one or no vertical braces. Broad, short sandwich boards may have more vertical braces and less cross braces.

BRIEF DESCRIPTION OF THE DRAWINGS

An embodiment of the invention will now be described by way of example with reference to the drawings, in which.

DETAILED DESCRIPTION OF A PREFERRED EMBODIMENT

Figure 1:
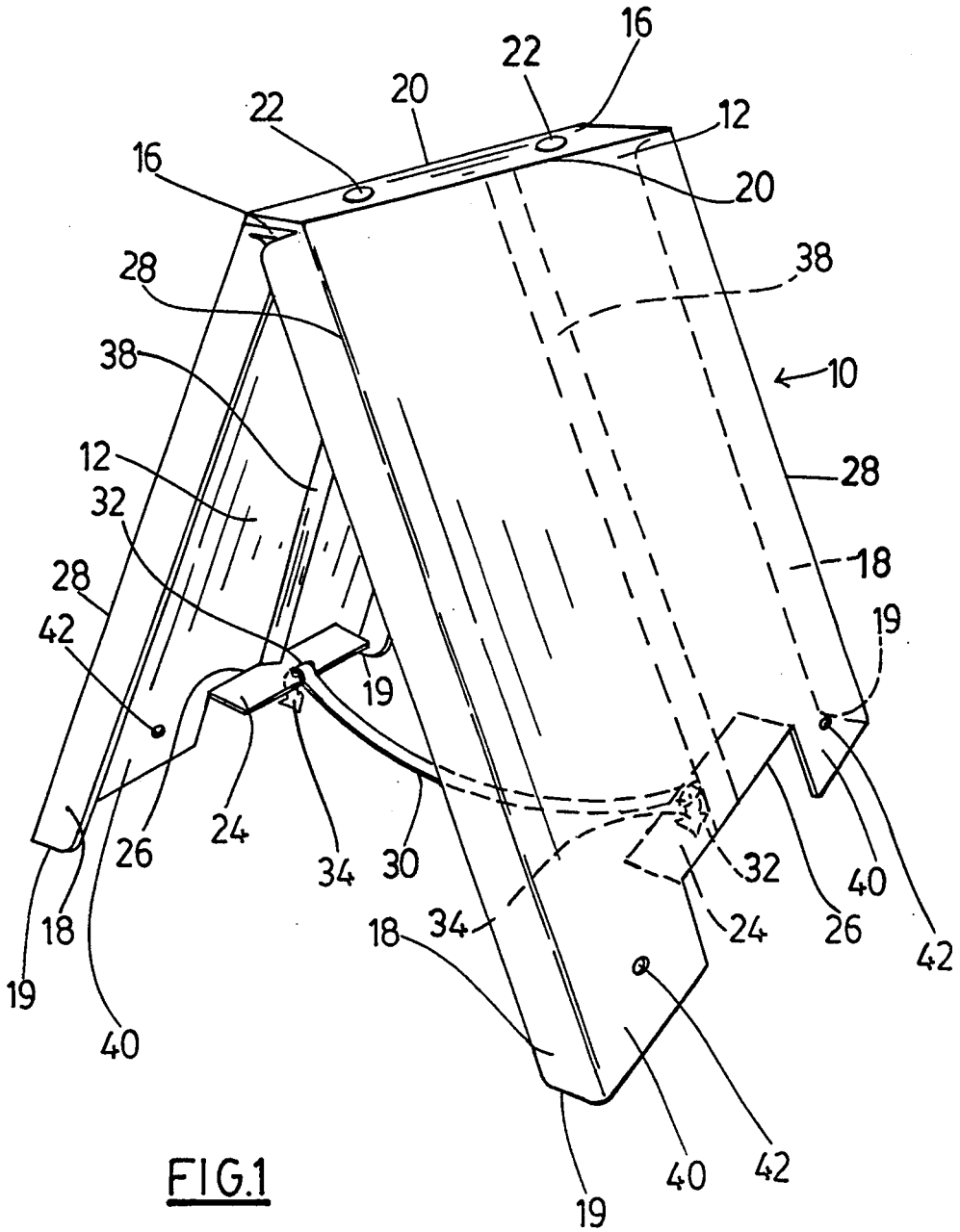
FIG. 1 is a perspective view of one sandwich board according to the invention in its opened or standing position.

FIG. 1 shows a sandwich board 10 in its open or standing position. The sandwich board comprises a pair of panels 12 each having an outer surface for the presentation of advertising information and an inner surface. The outer surfaces are coated all over the surface with an ink which adheres to plastics material so that it is suitable for over-printing with the advertising information. The panels 12 are hinged to one another through end flanges 16 which are respectively folded from respective panels 12 through coined fold lines 20. In use, in the position shown in FIG. 1, the flanges 16 overlie one another in a horizontal disposition and are attached together by bolts 22. Bolts 22 may suitable be made of plastics material, such as nylon which will not unduly interfere with later recycling of the sandwich board 10.

Each panel 12 may be die stamped from the sheet of rigid high density polyethylene. Each die stamped piece comprises a panel 12, an upper horizontal flange 16, side flanges 18, and a lower cut out flap 24. For simplicity the upper horizontal flanges 16 will be always referred to as being horizontal although it will be appreciated that when the sandwich board is folded and stacked, for example on its side, the flange 16 will not then be located in its normally horizontal position. Similarly side flanges 18 will always be referred to as vertical side flanges although, in the open standing position of the sandwich board, these flanges 18 are, in fact, angled to the vertical. When the sandwich board is folded and stored away the flanges 18 may be in any convenient position. Cut out flaps 24 are bent inwardly of panels 12 when the sandwich board is in the position shown in FIG. 1 through a fold line 26. The fold line 26 will always be referred to as a horizontal in spite of the differences in orientation caused by the folded sandwich board. The vertical side flanges 18 are folded inwardly from respective panels 12 on fold lines 28. Fold lines 28 will always be referred to as vertical fold lines in spite of potential changes of position due to orientation of the folded sandwich board.

Figure 7:
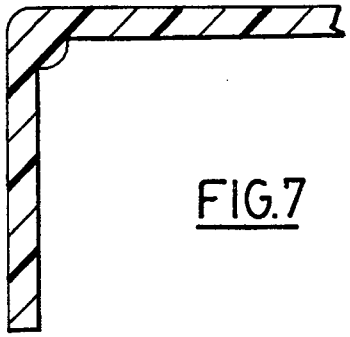
FIG. 7 is an enlarged detail of a section through one type of bend utilized in sandwich boards according to the invention.

Vertical side flanges 18 are folded inwardly at 90 degrees to panel 12 through a reverse bend. To form this permanent bend, the material is softened and a flange is first bent 90 degrees or thereabouts in a direction opposite to that eventually desired. This flange is thereafter bent into the eventually desired position and allowed to cool. The reverse bend gives a final bend with a bead in the angle of the bend. This may best be seen from FIG. 7 showing in somewhat exaggerated view, a cross section through the bend. This type of bend is used for the vertical side flanges 18 to provide maximum stability and strength to the plain of panel 12. The bottom edge 19 of flange 18 is angled to be generally horizontal to the ground when the sandwich board is open.

Figure 8:
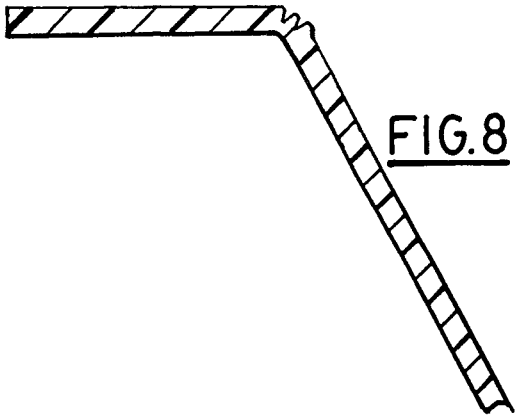
FIG. 8 is a detail of a section of a second type of bend used in sandwich boards according to the invention.
Figure 9:
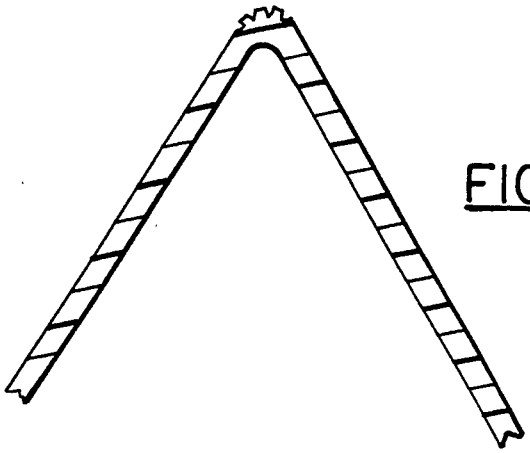
FIG. 9 is a detail of a section of a third type of bend used in sandwich boards according to the invention.

Horizontal bend 20 between panel 12 and flange 16 and bend 26 between cut out flap 24 and panel 12 are provided as double bends through double coined lines. Such bends are best seen in FIG. 8 showing an enlarged section through the bend. These bends are especially appropriate where frequent hinging movement is likely. Thus, a sandwich board may frequently be moved from one location to another and for movement it is probable that the board will be closed into the conditions shown in FIG. 2. A double bend in bends 20 and 24 provides a high degree of hingeability with reduced risk of fatigue breakage of the plastic due to frequent opening and closing of the sandwich board.

Cut out flaps 24 hinge inwardly in a double bend 24 to provide tabs for a limiting strap or straps 30, the purpose of which is to limit the angle of opening between panels 12. The length of strap 30 is chosen so that the panels 12 are permitted to open to an angle such that the panels are sufficiently open for easy reading of the advertising information thereon and sufficiently wide for stability but not so wide that the purpose of the sandwich board is lost.

Apertures 32 may be provided in cut out portion 24 for passage of strap 30. Strap 30 may be connected in any suitable way as by providing the straps ends with non-return arrow heads 34. The arrow heads 34 are threaded through apertures 32 and are secured against return by barbs of the arrow heads. Alternatively, the ends of the straps may be welded together or to the web of the strap. An alternative to arrow heads might be, for example, knots in the end of the strap. Various ways of attaching strap 30 may be easily devised. It is, however, important for eventual recycling considerations that metal attachments or other non-recyclable parts, should preferably not be used. If metal parts are used, it will be necessary to separate them out when recycling the material for reuse for another use.

Figure 10:
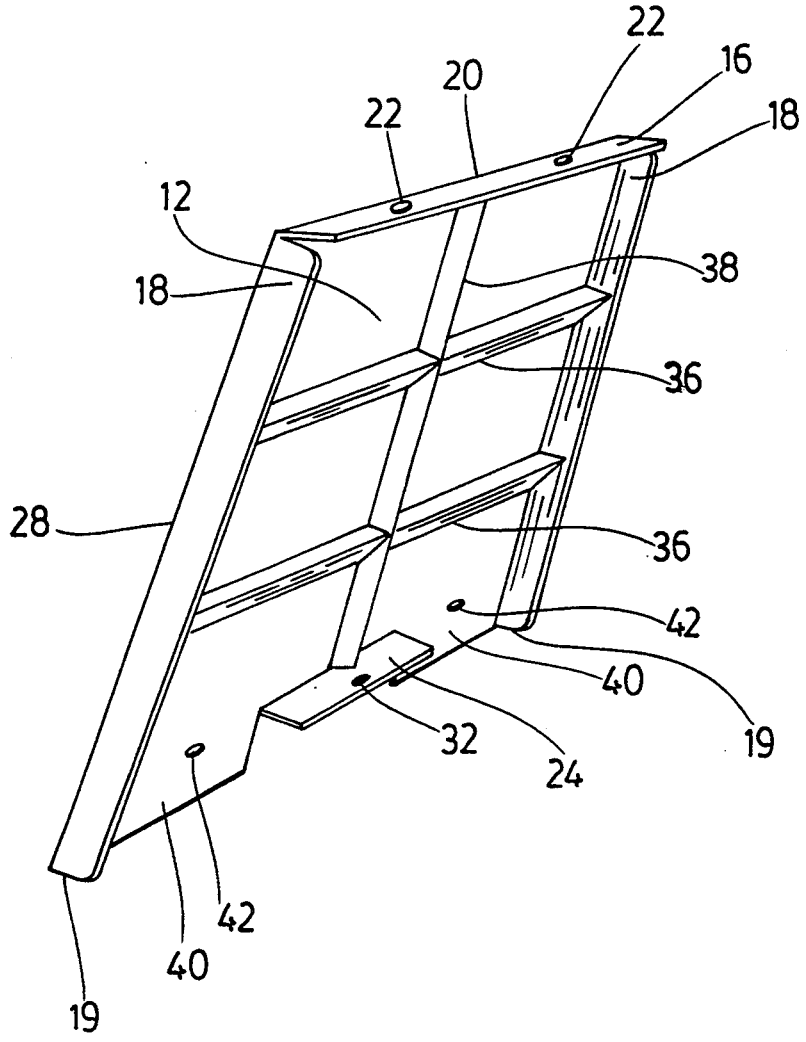
FIG. 10 is a view of the inner side of one of the panels of a sandwich board having a large surface area.

When a very small sandwich board is to be produced, the foregoing description of its construction may be complete. Thus, no further struts or braces may be necessary. However, for sandwich boards of any appreciable size it may be desirable to include at least one bracing strut 38. The number and location of such bracing struts may be a matter of choice dependent on the size of the panel 12. For example, for sandwich boards which have a greater dimension in the vertical direction than their dimension in the horizontal direction. A single vertical strut 38 as illustrated in FIGS. 1, 2, 3 and 4 may be sufficient. Such a strut may generally be used in sandwich boards having a horizontal dimension in the range of from 2 ft. to 3 ft. and a vertical dimension in the range of from 3 ft. to 4 ft. Such dimensions are of course not limiting but are provided for general guidance. For a sandwich board having a greater horizontal dimension than vertical dimension it may be sufficient to provide a single horizontal strut. For larger sandwich boards it may be desirable to provide more than one strut. Such a larger sandwich board is illustrated in FIG. 10, showing a single vertical strut 38 and two horizontal struts 36.

The actual form of struts of 38 and 36 may be as elongate members of V-shaped section. The elongate member may be placed on the inner surface of panel 12 so that the panel 12 closes the open mouth of the V. The strut 38 or 36 may then be tack welded to the end surface of the panel 12 or attached in any other suitable manner. It is believed that the dishing or bowing tendency of panel 12 may be suitable counter attacked by forces in the V-section of strut 38 or 36.

Figure 2:
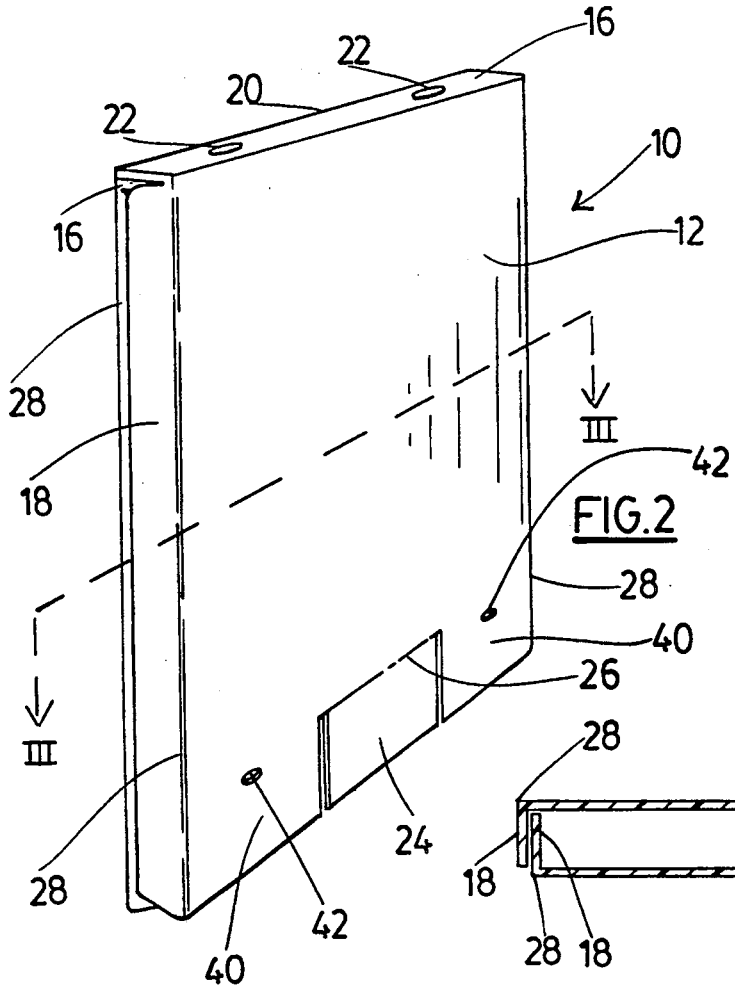
FIG. 2 is a view of a sandwich board of FIG. 1 in folded or closed position.
Figure 3:
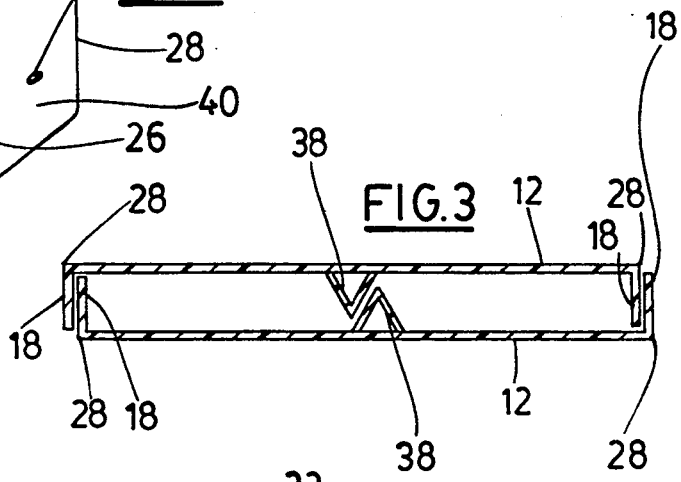
FIG. 3 is a cross section on the line III—III of FIG. 2.
Figure 4:
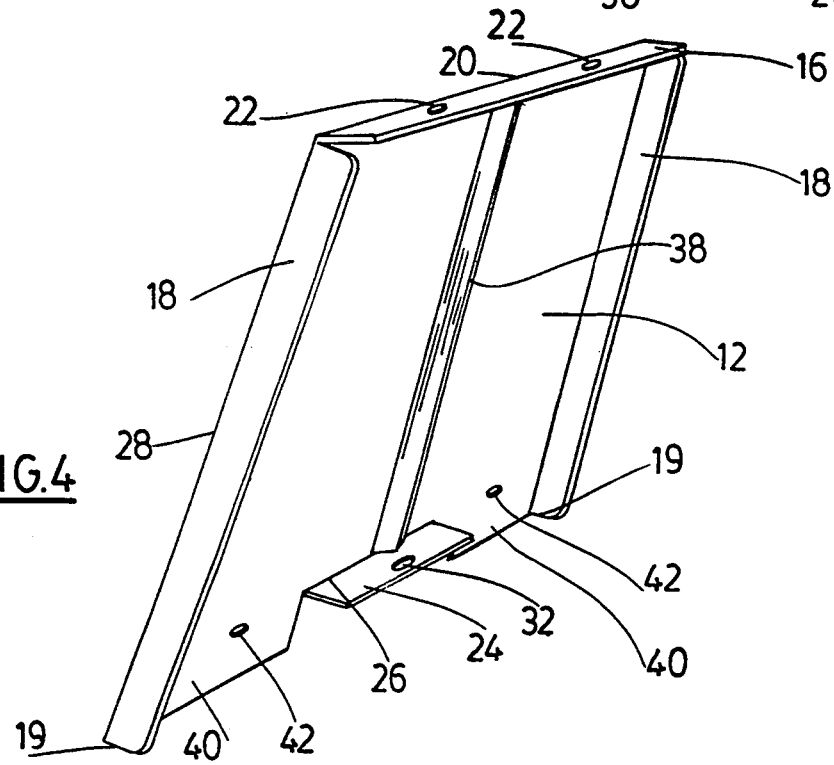
FIG. 4 is a view of the inner surface of one of the panels of the sandwich board of FIG. 1–3.
Figure 5:
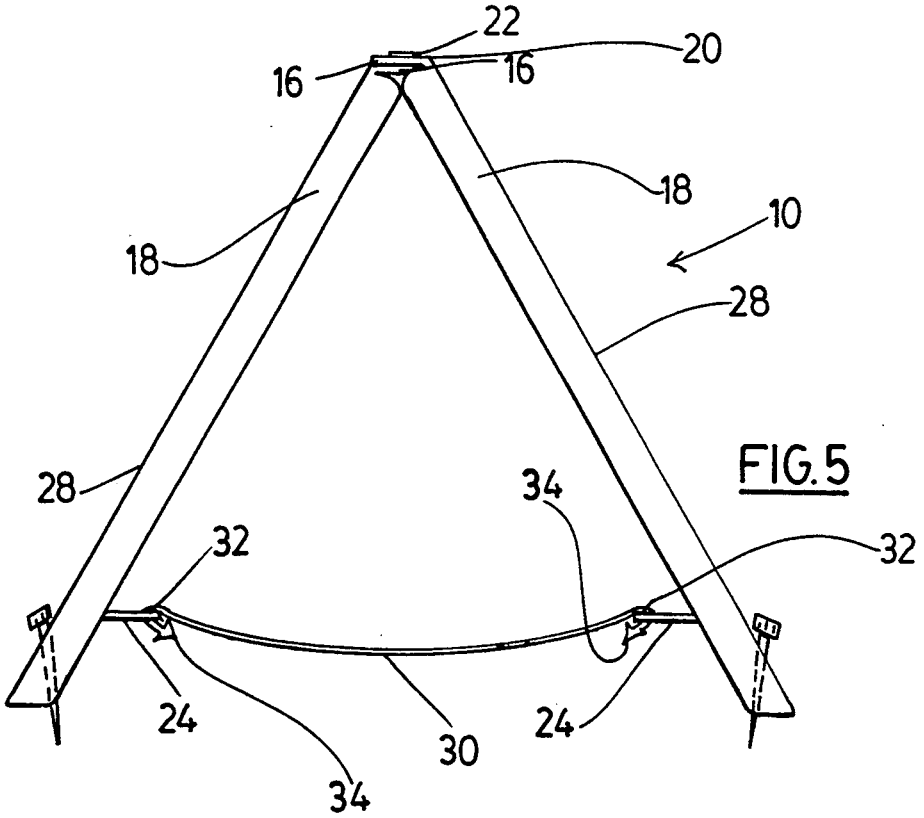
FIG. 5 is an end view of the sandwich board of FIGS. 1–4 in its opened position showing one means for limiting the angle of opening.

In a particular construction of sandwich board 10 as shown in FIGS. 1 to 5, the location of single vertical strut 38 is generally substantially centrally of its respective panel 12. If the pair of panels 12 of each sandwich board were set exactly opposed to one another, both the struts 38 and the vertical flanges 18 would foul each other when the board closed into its folded position as shown in FIG. 2. Therefore, in assembling the sandwich board 10, the panels 12 are laterally offset from each other so that when the board is folded the struts 38 of each panel lie side by side and the flanges 18 of opposed panels 12 also lie side by side. On one edge of the folded sandwich board the vertical flange 18 of one panel 12 will lie to the outside. At the other edge of the folded sandwich board a vertical flange 18 of the other panel 12 will lie to the outside. This arrangement may best be seen from FIGS. 2 and 3.

When the sandwich board 10 is folded cut out flaps 24 may be hinged down to lie in the plane of respective panels 12. Thus cut out flaps 24 do not impede folding of the sandwich board. In the folded position of the sandwich board 10, the length of strap 30 may be tucked inside the panels 12.

When the sandwich board 10 is in its open position and cut out flaps 24 are bent inwardly, one effect is the formation of legs 40 formed by the lower part of panel 12 and the lower part of each respective vertical side flange 18 and the lower parts of flanges 18. Aperture 42 may be provided in the lower part of legs 40. The sandwich board may then be pegged to soft ground by means of pegs passing directly through apertures 42. When the ground is hard concrete ties may be used.

Pegs for attaching the sandwich board to the ground may not always be suitable and some times of year such as during winter when the ground is frozen hard. An alternative construction of sandwich board is illustrated in FIGS. 6A, 6B abd 6C which may be more suitable to winter use.

Figure 6A:
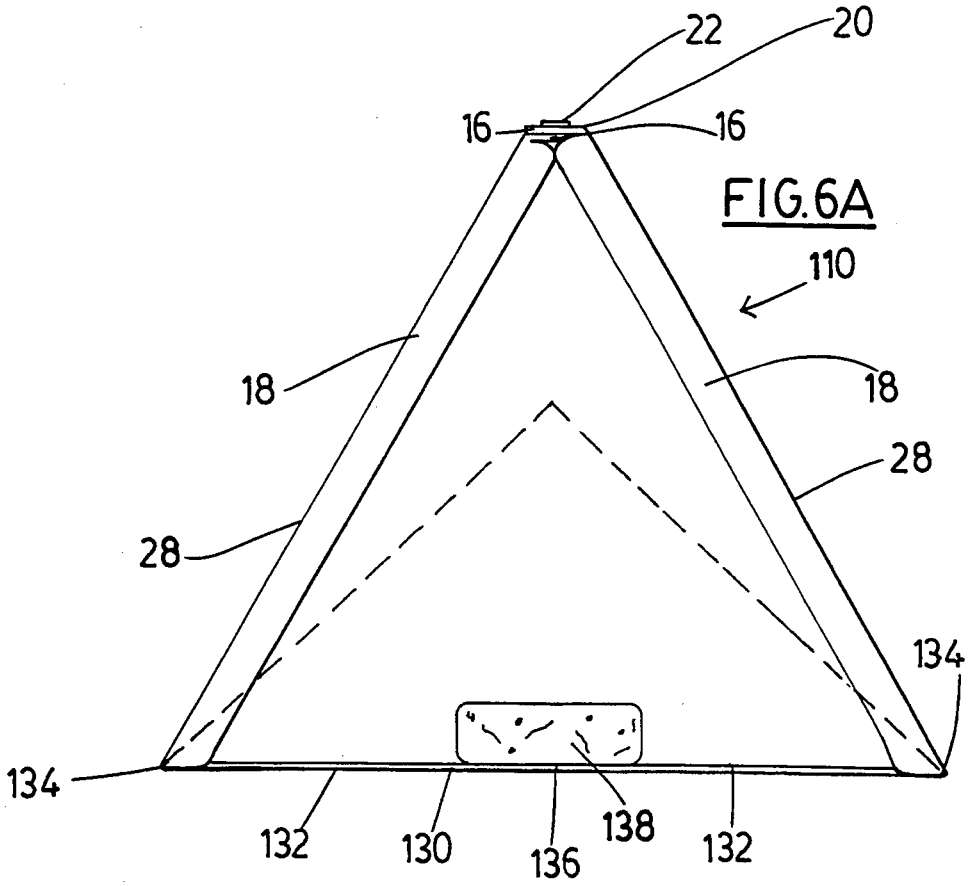
FIG. 6A is an end view of another sandwich board according to the invention showing a second means of limiting the angle of opening.
Figure 6B:
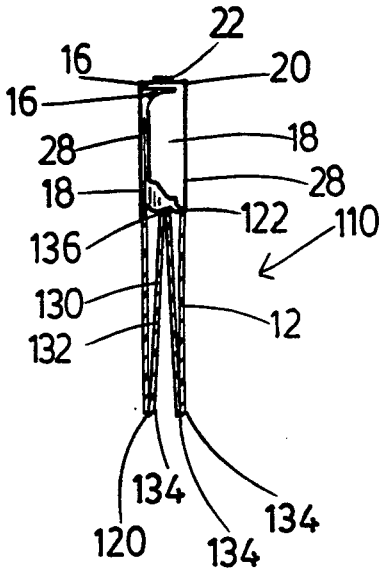
FIG. 6B is an end view of the sandwich board of FIG. 6A in its folded position.

The sandwich board 110 illustrated in FIGS. 6A and 6B is similar in every respect to that of the sandwich board 10 illustrated in FIGS. 1 to 5 with the exception that cut out flaps 24 and strap 30 are not present. Instead of cut out flaps 24 and strap 30, a hinged limiting web 130 is provided. The hinged restraining web 130 comprises two panels 132. Each panel 132 is connected at one edge 134 to a lower edge of one the panels 12 of the sandwich board 110. Edges 136 of panels 132 which are opposed to edges 134 are connected together. The distance between edges 134 and 136 of panel 132 is such that when the sandwich board is in its open position shown in FIG. 6A the panels 132 lie horizontally flush with ground or other substrate on which the sandwich board rests. When the sandwich board is folded into its closed position in FIG. 6B the panels 132 hinge upwardly to lie flush with and overlaid by the panels 12 of the sandwich board 110. This hinging direction is shown in dotted lines in FIG. 6A.

In use it is possible to stabilize the open sandwich board against blowing in the wind by providing a heavy weight 138 on top of the opened panels 132.

Figure 6C:
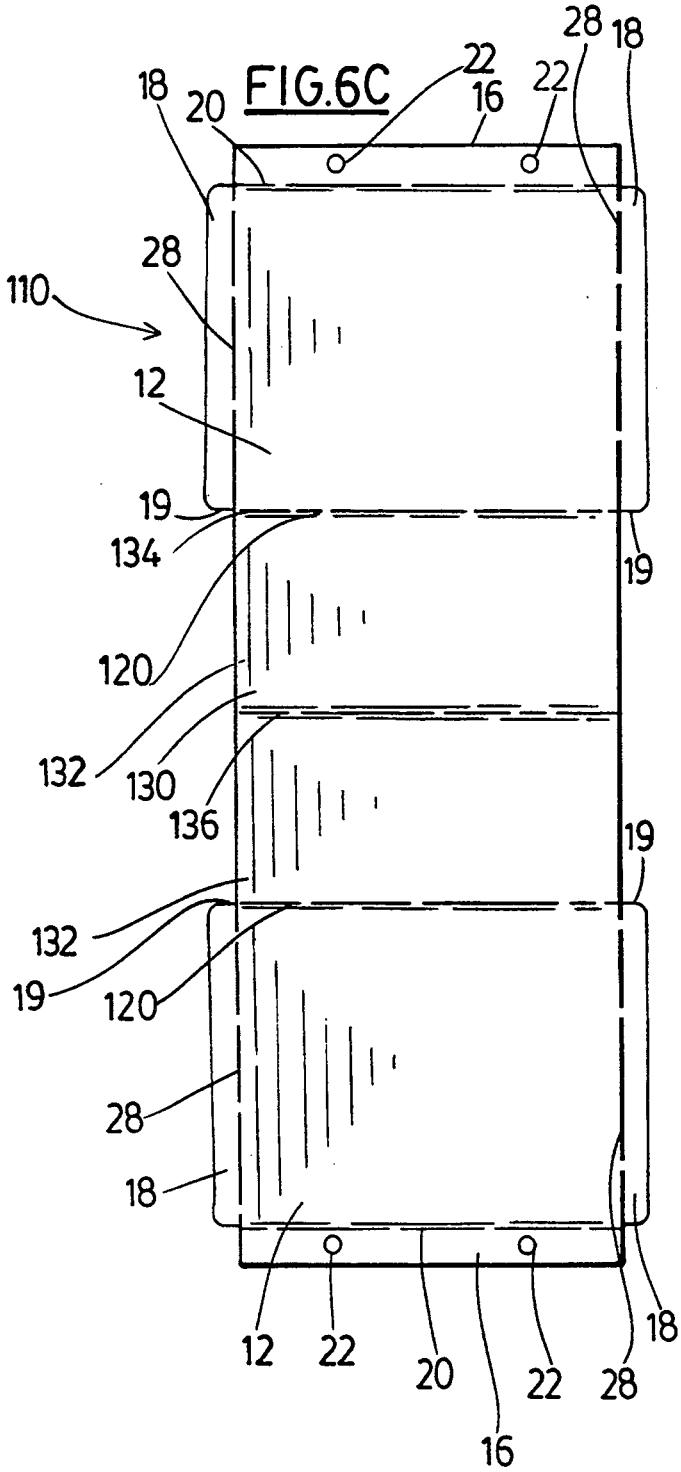
FIG. 6C is a view of a single carton blank from which the sandwich board of FIGS. 6A and 6B is formed.

This construction of sandwich board 110 may not fold as flat as the sandwich board 10 of FIGS. 1 to 5 since the presence of panels 132 may prevent nesting of any struts 30 or 40 and vertical side flanges 18. Nevertheless, where pegging of the sandwich board is not practicable, the construction of FIG. 6A and 6B may be suitable. Moreover, the construction of 6A and 6B may be die-stamped in a single piece from a larger sheet. FIG. 6C shows a sandwich board blank for the construction of FIG. 6A and FIG. 6B. The blank of FIG. 6C shows double coining for the double bend 20 between horizontal flange 16 and panel 12, and double coining 120 between lower edges of panels 12 and edges 132 of panels 130, and triple coining for a triple bend 122 between edges 134 of panels 130.

The double bend provided between the lower edge of panel 12 and adjoining 130 is provided for similar reasons to those discussed herein above in connection with double bends 20 and 26. The triple bend 122 is provided to give even greater flexibility in the bend between panels 130.

Figure 11A:
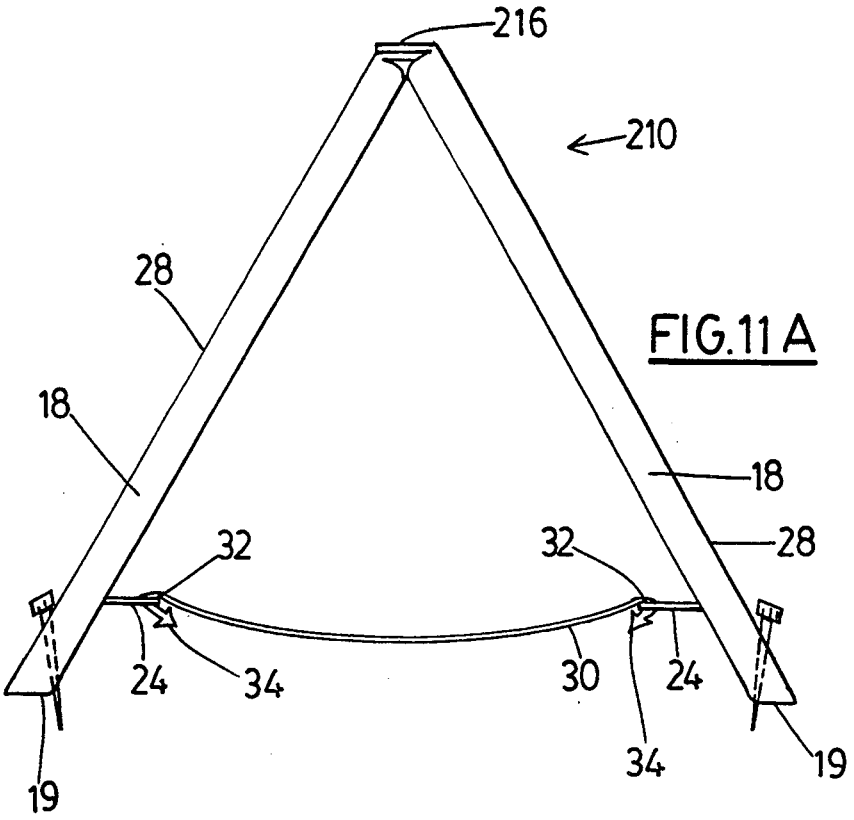
FIG. 11A is a view of another sandwich board according to the invention.
Figure 11B:
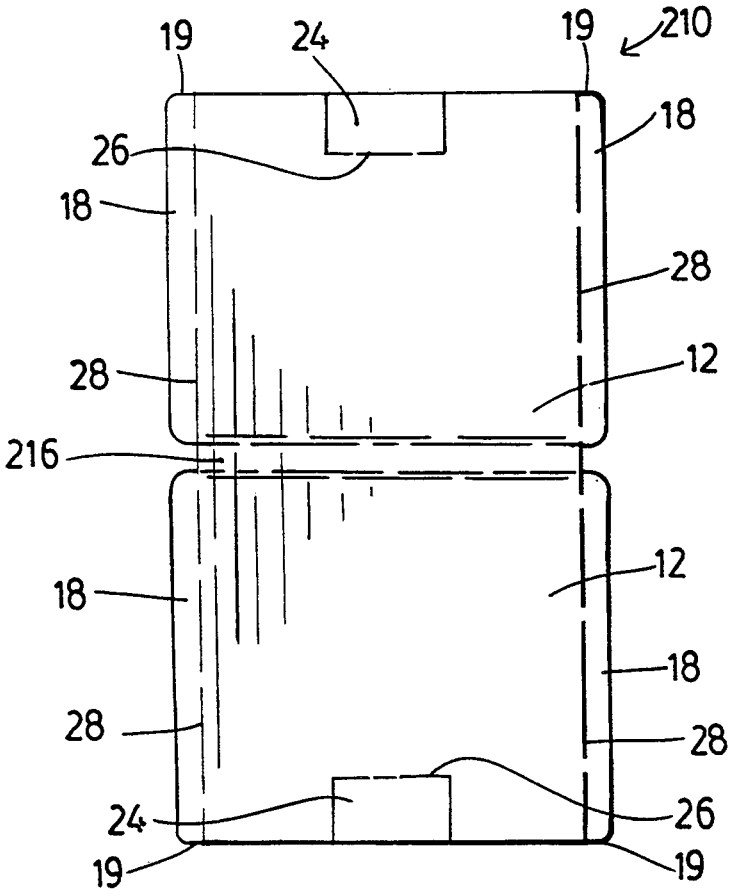
FIG. 11B is a view of a blank for making a sandwich board as shown in FIG. 11A.

FIGS. 11A and 11B show another embodiment of sandwich boards 210 which is similar to the sandwich board 10 of FIGS. 1 to 5 except that it is formed from a single blank (see FIG. 11B) and has a top flange 216 common to both panels 12. The construction of the top formed from single flanges 216 does not add quite such great rigidity to top edge as does the overlaid flanges 16 of the sandwich board 10. Nevertheless, the fact that sandwich board 210, like sandwich board 110, may be cut from a single blank may provide economy in manufacture. Sandwich board 210 is illustrated with cut-out flaps 24 and strap 30, but it will be appreciated that if it is possible to provide lower flanges 130 and weight 138 instead. Of course it will not be possible to provide continuity of surface between both flaps 132 and top flange 216, but is quite possible to hinge flaps 132 together using, for example plastic ties.

Generally, whether the construction of FIGS. 1 to 5 is being manufactured or whether the construction of FIGS. 6A, 6B and 6C is being manufactured or whether the construction of FIGS. 11A and 11B is being manufactured, the process steps in the production of the sandwich board may be as follows.

Firstly, the whole surface of a sheet of rigid polyethylene is flooded with an ink suitable for adhering firmly and permanently to the surface of plastic materials such as polyethylene. The ink may be transparent or may be of a color suitable as a substrate for further later printing. One suitable type of ink is an air curing epoxy ink which will adhere to polyethylene. An example of such an ink is that sold under the trade mark Colonial C 91 by the Screentec Corporation.

Secondly, blanks suitable for forming the sandwich board 10 of FIGS. 1 to 5 or a single blank suitable for forming the sandwich board 110 of FIGS. 6A and 6B, or a single blank suitable for forming the sandwich board of FIG. 11A are die-cut from the ink coated sheet.

Thirdly the blanks are double or triple creased to form the bends 26, 20, 120, or 122. The bends 20, 26, and 120 are double coined and bend 122 is triple coined. When making these coin lines care should be taken that the ink coated surface of the blank is located so as to be the outer surface of the resulting sandwich board.

Fourthly advertising information or other printing is provided on the ink coated surface. Such advertising information or other display may be provided with very conventional materials such as standard paint suitable for outdoor use or conventional printing ink.

Fifthly finishing details may be applied to the blank such as the provision of apertures 32, 42 and apertures for the bolts 22. The blanks may then be folded into proper configuration and bolts 22 may be screwed into position. Strap 30 or other restraining means is also fitted.

I claim:

1. A sandwich board formed from rigid recyclable plastics material sheet, comprising:

a pair of overlying panels;

each panel having an outer surface for the presentation of information, the outer surface being coated with an ink adherent to the plastics material;

each panel having opposed elongate side flanges extending along opposed sides of the panel and bent inwardly at substantially 90 degrees from the outer surface thereof;

each panel having a lower flange hingable inwardly from a horizontal hinge line in a lower part of the panel; the panels being hingably connected at respective top edges of the panel through at least one top member coextensive with the top edges of both panels; and restraining means extending between lower parts of the panel to limit the angle to which the panels hingable with respect to the top member.

2. A sandwich board as claimed in claim 1 in which the ink is an air curing epoxy ink.

3. A sandwich board as claimed in claim 1 in which the top member is a top flange common to both panels.

4. A sandwich board as claimed in claim 3 which is cut from a single blank.

5. A sandwich board as claimed in claim 1 where each panel has a top flange hingably connected thereto and the top flanges overlie one another in flush relationship and are attached together.

6. A sandwich board as claimed in claim 1 in which the limiting means is a strap between lower parts of the panels.

7. A sandwich board as claimed in claim 1 in which lower flanges are connected together to form the limiting means.

8. A sandwich board as claimed in claim 2 which is cut from a single blank.

9. A sandwich board as claimed in claim 1 having at least one reinforcing strut on a back surface of each panel.

10. A sandwich board as claimed in claim 9 in which the panels are slightly laterally offset to allow nesting of side flanges and struts.

* * * * *